United States Patent [19]

Martone

[11] Patent Number: 4,815,866

[45] Date of Patent: Mar. 28, 1989

[54] EXPANDABLE CONTAINER FRAME

[76] Inventor: David M. Martone, 3831 NE. 27th Ave., Lighthouse Point, Fla. 33064

[21] Appl. No.: 39,771

[22] Filed: Apr. 14, 1987

Related U.S. Application Data

[63] Continuation-in-part of Ser. No. 841,845, Mar. 20, 1986, abandoned.

[51] Int. Cl.[4] ..... B65D 33/02

[52] U.S. Cl. ..... 383/34.1; 141/390; 141/391; 248/100

[58] Field of Search ..... 141/10, 313, 316, 383, 141/390, 391; 150/121, 143, 900; 248/97, 99, 100, 101; 383/34, 34.1

[56] References Cited

U.S. PATENT DOCUMENTS

| | | | |
|---|---|---|---|
| 224,318 | 2/1880 | Yerdon | 248/100 |
| 761,962 | 6/1904 | Hill | 150/121 |
| 860,183 | 7/1907 | Bair | 383/34.1 |
| 966,695 | 8/1910 | Lincoln | 383/34.1 |
| 2,088,752 | 8/1937 | Laitman | 150/121 |
| 2,789,781 | 4/1957 | Miller | 248/100 |
| 2,903,033 | 9/1959 | Robinson | 383/34 X |
| 3,653,619 | 4/1972 | Plum | 248/99 |
| 3,744,081 | 7/1973 | Miller | 248/101 X |
| 3,983,914 | 10/1976 | Benson | 141/390 |
| 4,069,994 | 1/1978 | Wharmby | 248/99 X |
| 4,273,167 | 6/1981 | Stillwell | 141/391 X |
| 4,601,315 | 7/1986 | France | 141/316 X |

*Primary Examiner*—William A. Cuchlinski, Jr.

*Attorney, Agent, or Firm*—Lockwood, Alex, FitzGibbon & Cummings

[57] ABSTRACT

A foldable and expandable frame for use independently of or as a part of a wall mounted system for reinforcing the opening periphery of a flexible container, such as a plastic bag or the like, to facilitate filling and emptying of the container. The frame includes a pair of identical frame members each hinged centrally thereof and at opposite ends interconnected with integral hinge pin portions to facilitate expanding movement of the frame from a folded parallel storage position to an expanded container reinforcing and holding position. The frame members include an integral locking arrangement which releasably locks the frame members in the storage and expanded positions. Bracket mounting means are included in the system to mount the frame on a vertical supporting surface.

42 Claims, 4 Drawing Sheets

FIG. 6
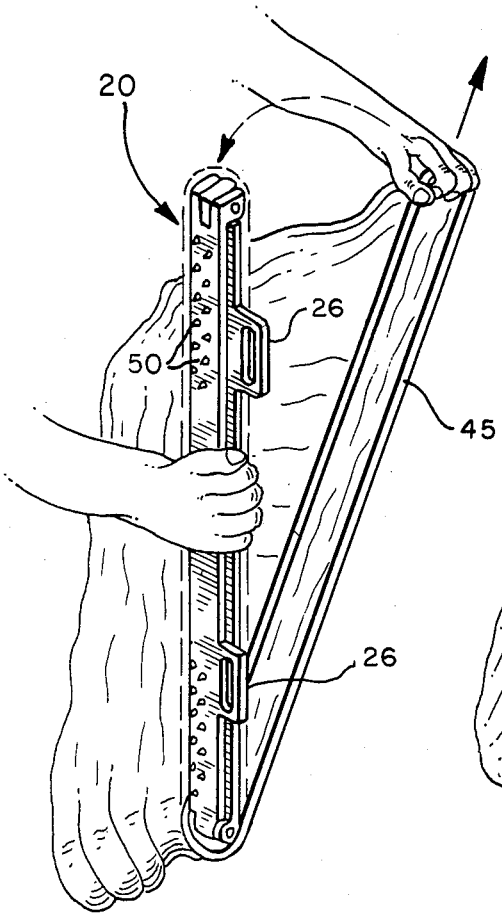
FIG. 10
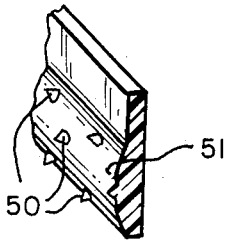
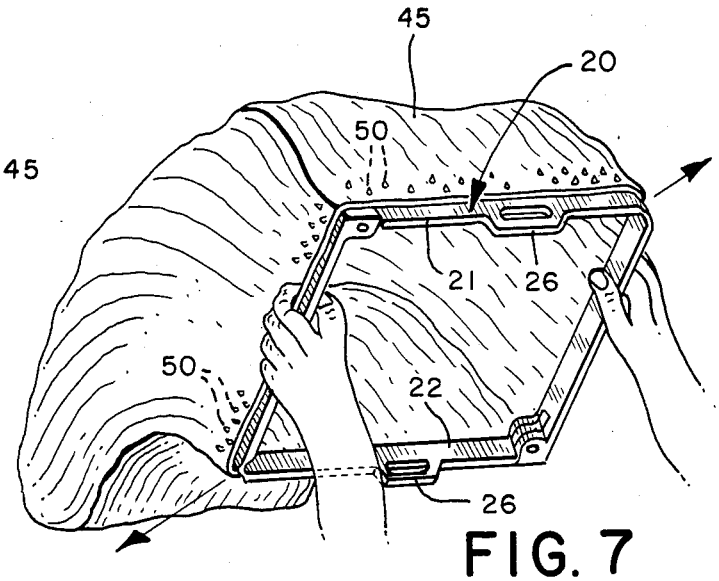
FIG. 7
FIG. 9
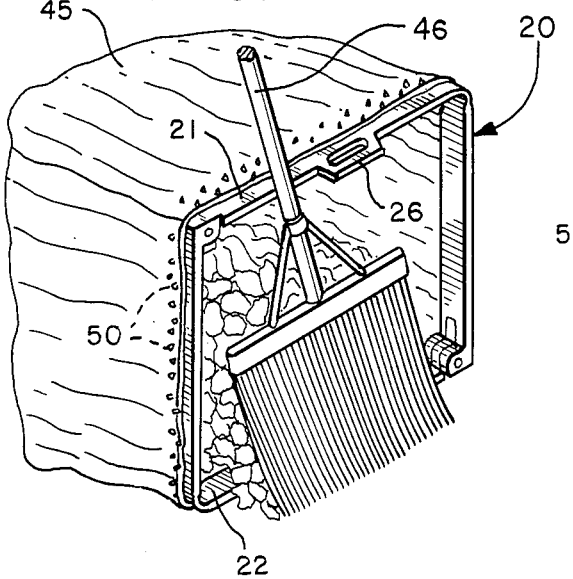
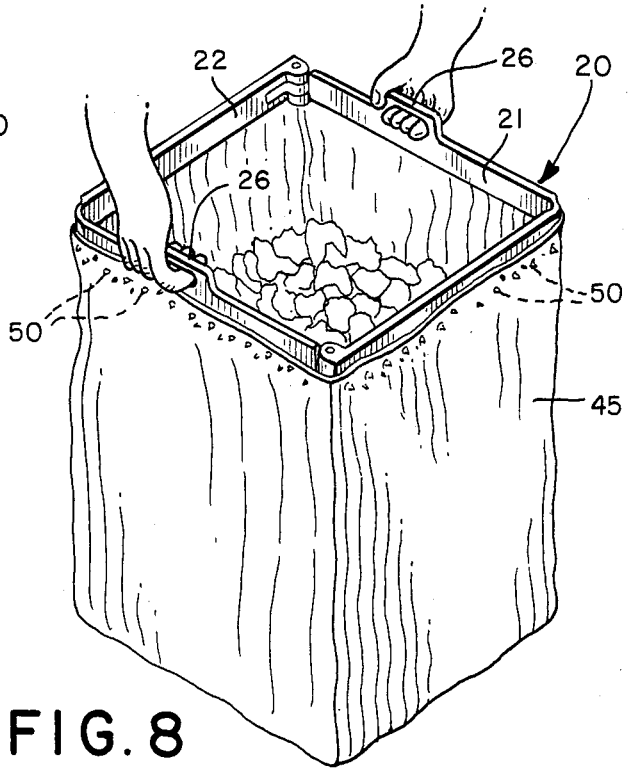
FIG. 8

FIG. 11
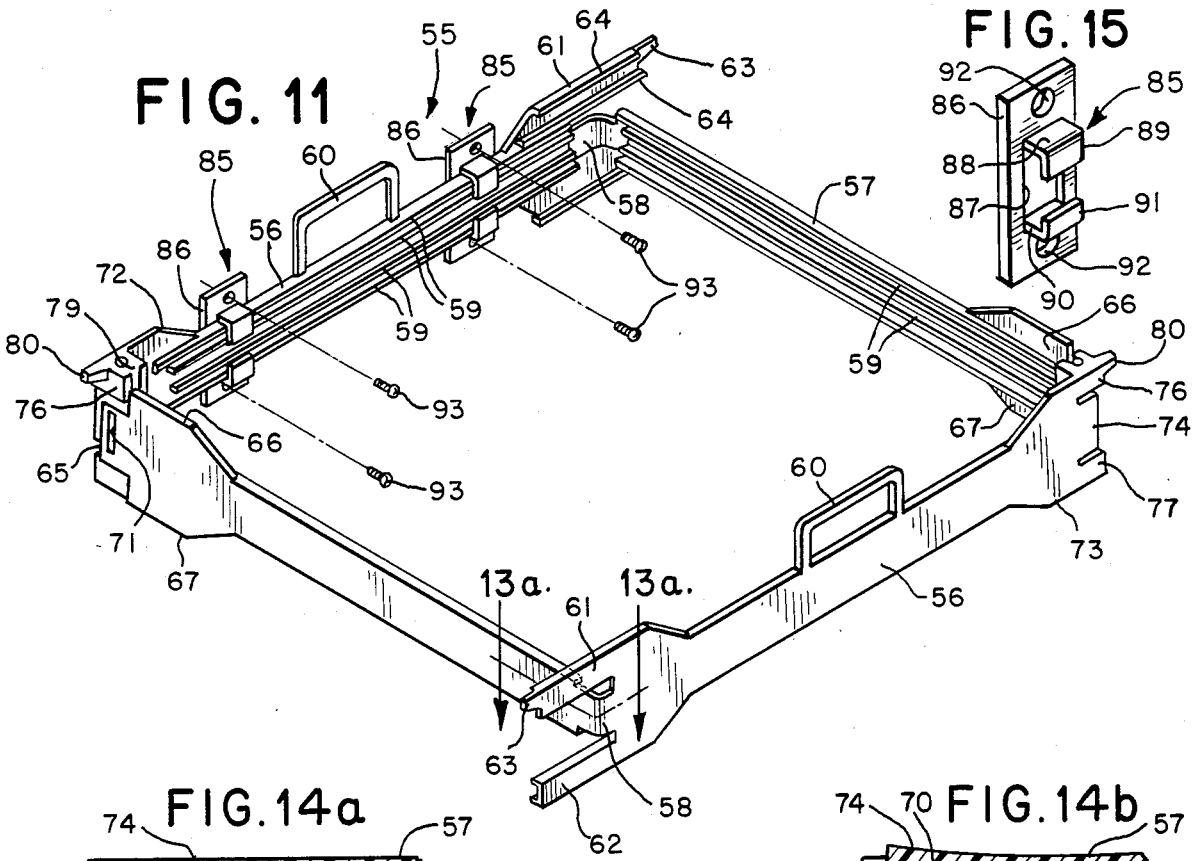
FIG. 15
FIG. 14a
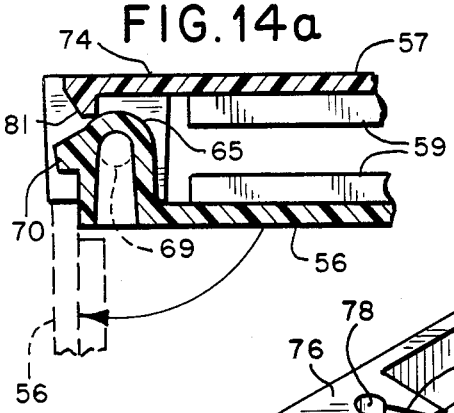
FIG. 14b
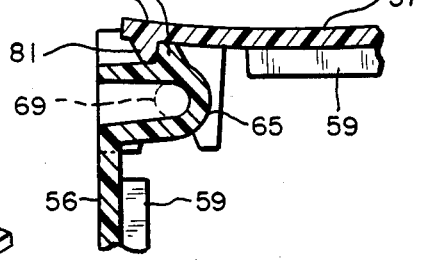
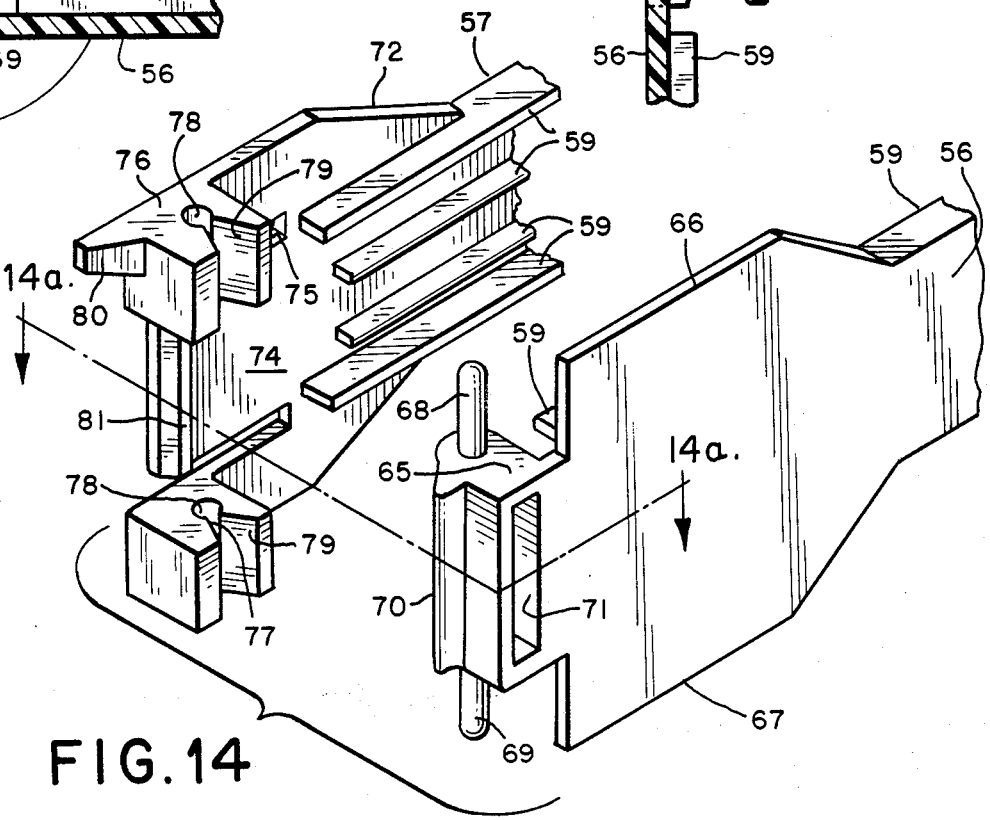
FIG. 14

12a.
12a.

EXPANDABLE CONTAINER FRAME

This is a continuation-in-part of application Ser. No. 841,845, filed Mar. 20, 1986.

BACKGROUND OF THE INVENTION

Flexible containers in the form of plastic bags or the like are extensively used for many different purposes. One such purpose, which is described as an example herein, is that of bagging garbage, trash, leaves or the like in the home environment. Common experience with plastic bags used in this application establishes that it is exceedingly troublesome, if not virtually impossible, to maintain the opening of the bag in an expanded condition so as to permit efficient loading of the bag. This problem is substantially magnified when one individual attempts to first, hold the opening of the flexible bag in an expanded condition, and second, load the bag while the expanded condition of the opening of the bag is maintained. The relatively large size and flexibility of such bags further magnifies the problem.

Manufacturers of flexible plastic bags have recognized the difficulties attendant in handling flexible plastic bags by encouraging use of the bags as liners, thus necessitating the utilization of a basket or can or other rigid container to receive the bag with the top flexible end portion thereof reversely draped over the top edge of the container so that the rigidity of the container retains the open condition of the bag. This solution, while widely used, has the disadvantage of restricting the versatility of use of the bag as well as reducing the total volume of the bag available for receiving trash or debris. For example, the conventional flexible plastic bag is not of a cylindrical configuration in its fully expanded condition, but of a configuration which more closely approximates a rectangular solid. If such a bag is confined in a cylindrical rigid container, which is the normal condition of use of such bags, the full available volume of the bag cannot be effectively utilized. Still further, whenever such a bag is confined in a rigid container for use in collecting trash, leaves or the like at different locations, it is necessary to carry the container, as well as the bag and collected trash. As the container itself is functioning solely to establish and maintain the expanded shape of the bag, and in the process is not permitting full utilization of such shape, it becomes dead weight which merely further complicates the trash collection chore.

Wall mounting of plastic bags, particularly bags of relatively large size, has not been effectively accomplished to any practical extent. The system utilized to mount a plastic bag must not only be capable of firmly holding the same for filling or emptying, but also should preferably permit efficient opening and closing of the open end periphery of the bag during use of the same.

The present invention overcomes the foregoing problems and effectively permits full volumetric utilization of a conventional plastic bag even in a wall mounted application by providing an expandable container frame or bag opener which can be readily installed in a flexible plastic bag to facilitate convenient filling and transport thereof, and which in combination with a wall mounting bracket can be readily incorporated in the aforementioned wall mounted application.

The invention in its preferred form comprises a pair of identical elongated frame members formed from a lightweight moldable plastic rubberized plastic or semi-hard rubber material. The frame members are hingedly connected at either end so as to lie when configured for storage in a side-by-side relationship. Each frame member intermediate the ends thereof is provided with a living hinge portion which, in conjunction with the interconnecting hinged connections of the frame members permits ready reconfiguration of the frame members into an expandable rectangular shape for use in holding the open end of the plastic bag open. Integral portions of the frame members cooperate when the frame is expanded to hold or lock the frame members in the expanded configuration.

The lightweight and functional characteristics of the frame members permit full and effective utilization of the available volume of a plastic bag, ready manipulation of the opened bag including the expanded frame during filling or emptying of the bag, ready movement of the bag by the user from one filling location to another, and ready incorporation in a wall mounting system.

SUMMARY OF THE INVENTION

An expandable container frame or bag opener includes a pair of elongated frame members pivotally interconnected at opposite ends thereof to permit expansion of the frame members by pivoting action thereof away from one another, such expansion being facilitated by a flexible area forming a part of each of the frame members intermediate the ends thereof and whereby the opposite ends may be moved toward one another during the expansion action. The bag opener is held in its expanded condition by locking means carried by the frame members and inter-engaging the same to releasably lock the frame members in the expanded bag opening condition. The bag opener may also be readily combined with a mounting bracket to establish a vertical surface mounting system to further enhance utilization of a flexible bag.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

Figure 4:
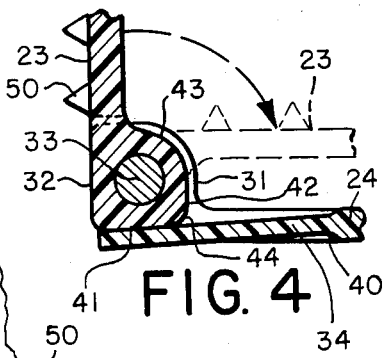
FIG. 4 is a fragmentary sectional view of the hinge arrangement of FIG. 3 as viewed along line 4—4 in FIG. 3 and with the parts of FIG. 3 assembled, FIG. 4 further illustrating in phantom certain operational characteristics of the hinge.

FIG. **4*a* is a view similar to FIG. 4** illustrating still other operational characteristics of the hinge in phantom.

Figure 3:
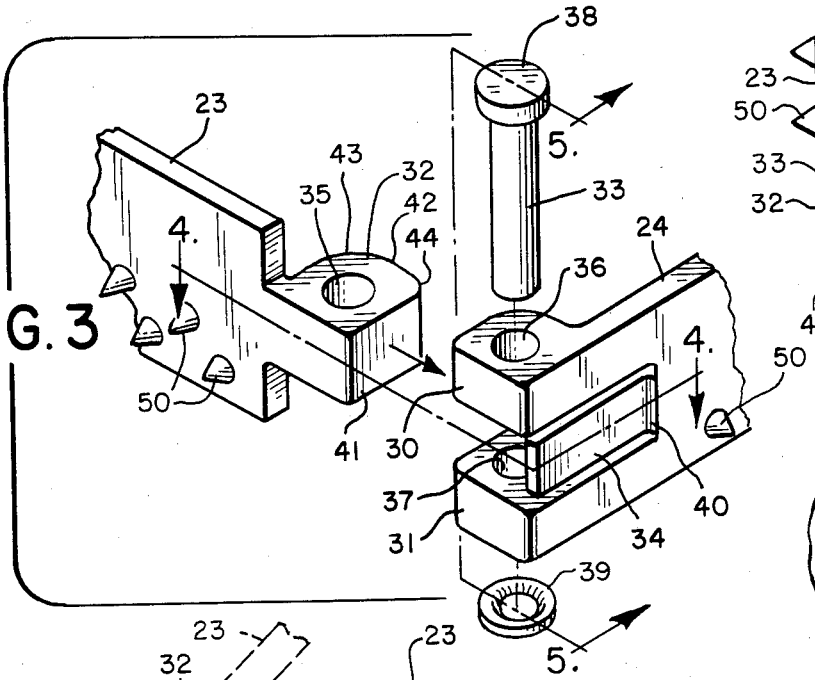
FIG. 3 is an exploded fragmentary view of one of the hinge arrangements of the expandable container frame of FIG. 1 including one form of the locking feature of the present invention.
Figure 5:
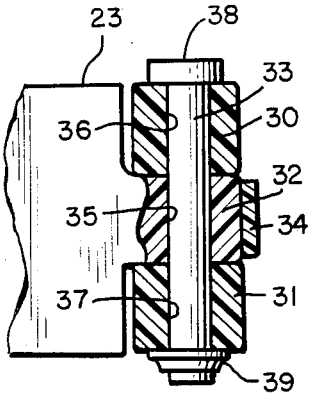

FIG. 5 is a fragmentary vertical section of the hinge of FIG. 3 as viewed along line 5—5 of FIG. 3 with the hinge of FIG. 3 assembled.

Figure 1:
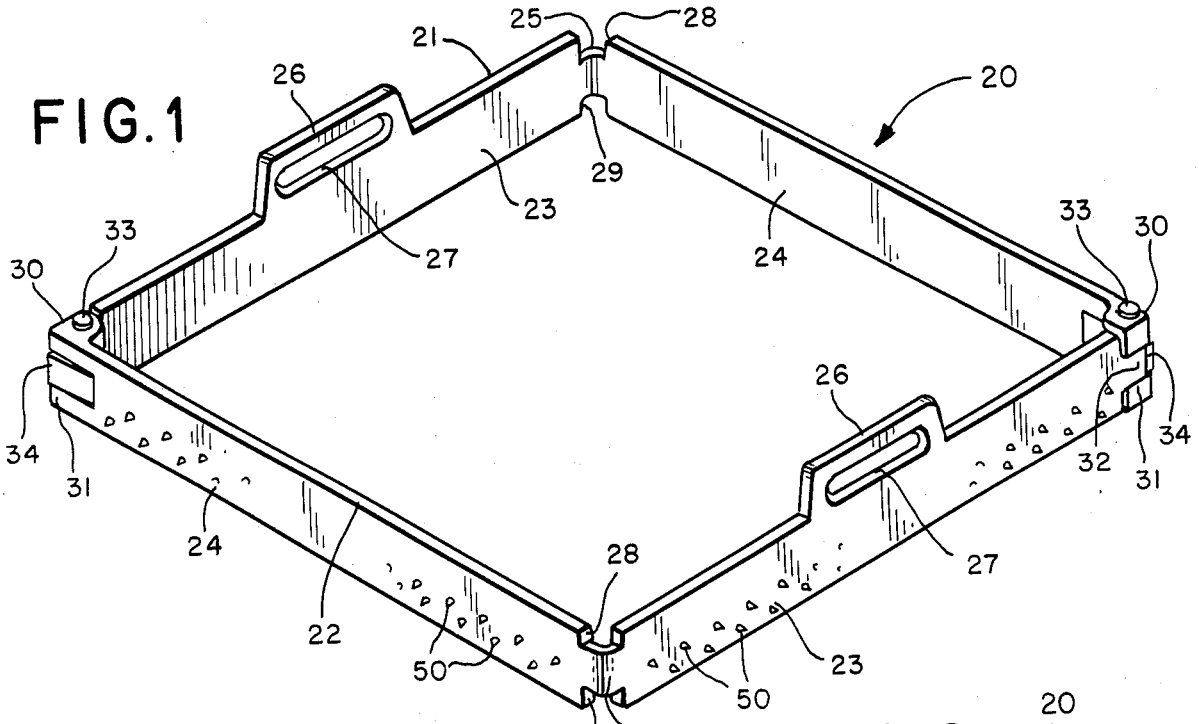
FIG. 1 is a perspective view of one form of expandable container frame of the present invention illustrating the same in its expanded operational configuration.

FIG. 6 is an illustration of the first operational step of attaching a flexible bag to the expandable container frame of FIG. 1.

FIG. 7 is an illustration of the expandable container frame of FIG. 1 being expanded within the opening of the flexible bag.

FIG. 8 is an illustration showing utilization of the flexible bag and expanded expandable container frame of FIG. 1 for receiving trash.

FIG. 9 is an illustration showing utilization of the flexible bag and expanded expandable container frame of FIG. 1 for receiving sweepings.

FIG. 10 is a perspective view of a portion of one frame member of the expandable container frame of FIG. 1 showing a construction for providing bag engaging protuberances on the outside surface thereof.

FIG. 11 is a perspective view of an alternative construction of the expandable container frame of the present invention illustrating the same in its expanded operational configuration.

Figures 12, 12A, 13, 13A:
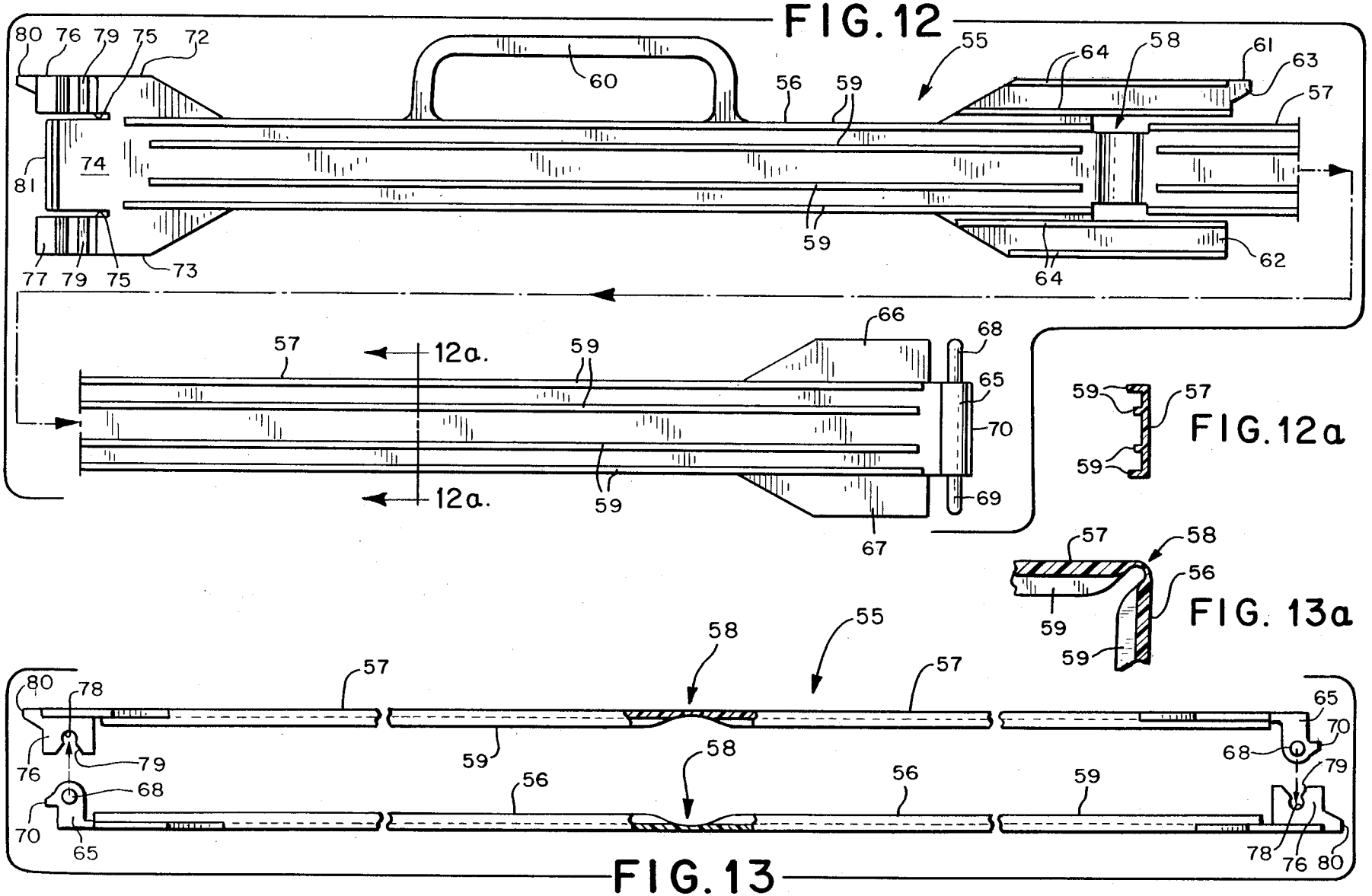

FIG. 12 is an enlarged fragmentary elevation of the expandable container frame of FIG. 11 illustrating the same in its contracted or folded configuration.

FIG. 12*a* is a cross-sectional view of the expandable container frame of FIG. 12 taken along line 12*a*—12*a* therein.

FIG. 13 is a fragmentary top plan view of the separated frame members of the expandable container frame of FIG. 12 showing portions thereof in partial section.

FIG. 13*a* is an enlarged fragmentary section of the expandable container frame of FIG. 11 as viewed along line 13*a*—13*a* therein.

FIG. 14 is an enlarged fragmentary perspective opposite end portions of the frame members forming the expandable container frame of FIG. 11 illustrating the same in separated relationship.

FIG. 14*a* is a fragmentary sectional view of the engaged ends of the frame members of the expandable container frame as viewed along line 14*a*—14*a* in FIG. 14.

FIG. 14*b* is a view similar to FIG. 14*a* illustrating certain operational characteristics of the expandable container frame of FIG. 11 when the same is in its expanded operational configuration.

FIG. 15 is an enlarged perspective view of a mounting bracket which, as further illustrated in FIG. 11, may be used with the expandable container frame of the present invention to establish a wall mounting system for flexible bag.

DESCRIPTION OF THE PREFERRED EMBODIMENT

Referring to the drawings, and in particular to FIG. 1, one form of expandable container frame or bag opener 20 constructed in accordance with the invention is seen to include a pair of identical frame members 21 and 22 formed from a suitable injection-molded plastic or semi-hard rubber material, such as polypropylene or vinyl. Each frame member includes frame sections 23 and 24 which are integrally interconnected by a living hinge section 25. Each frame section 23 along the top surface thereof and centrally thereof is provided with an upwardly projecting handle 26 having an apertured portion 27 for ready grasping. Indicia (not shown) such as a trade name or operating instructions may be applied to the outer surfaces of frame sections 23 and 24 by known methods such as hot stamping or by applying decals or paint.

Each living hinge section 25 in the embodiment shown is of lesser width than the associated frame sections 23 and 24 by reason of the sections in the area of the living hinges being provided with top and bottom recessed portions 28 and 29, respectively. Depending upon the material used and the inherent resiliency and memory characteristics of such material, the depth of the recessed portions is selected so that the requisite amount of plastic material remains to form a living hinge which will permit folding of the frame sections 23 and 24, and yet provide sufficient restoring force to continuously urge the sections back toward a parallel or in-line relationship.

The end of each frame section 24 includes an upper hinge ear or tongue 30 and a vertically spaced lower hinge ear or tongue 31 which define therebetween the female portion of a pivotal hinge arrangement. The end of each frame section 23 includes a single, centrally positioned hinge ear or tongue 32 constituting the male portion of the pivotal hinge arrangement when received between the vertically spaced ears 30 and 31 of the adjacent end of the other frame section 24. A metal hinge pin 33 extends through the aligned apertures of the cooperating ears 30, 31 and 32.

To lock the frame sections in the expanded and retracted configurations, a flexible locking tab portion in the form of a tongue 34 is integrally formed on each frame section 24 at the pivot hinge end thereof. The locking tab 34 is located between the vertically spaced ears 30 and 31 and is laterally movable therebetween. The longitudinal extent of the locking tab 34 is selected to provide a necessary degree of resiliency, and may vary depending upon the material utilized in forming the frame members.

Figure 2:
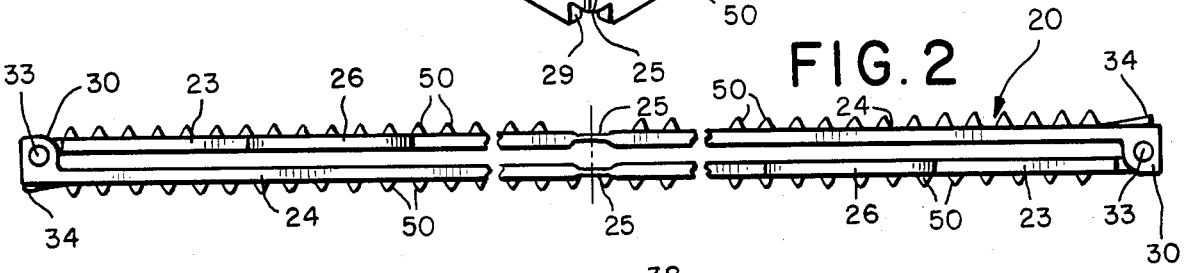
FIG. 2 is a fragmentary top elevation view of the expandable container frame of FIG. 1 illustrating the same in its contracted or folded configuration.

FIG. 2 illustrates the compact storage configuration into which the bag opener of the present invention is foldable. In this configuration the frame sections 23 and 24 overlie one another, the inherent resiliency of the living hinges cooperating with a locking force provided by the pivotal arrangements between the frame members to maintain the frame members in position.

FIGS. 3, 4, 4*a* and 5 illustrate in detail the structural features and operational characteristics of each of the hinge pin assemblies interconnecting adjacent ends of frame sections 23 and 24. The male hinge pin ear 32, which is provided with an aperture 35, is received between the vertically spaced female hinge pin ears 30 and 31. Ears 30 and 31 are each provided with apertures 36 and 37 which are aligned with one another and become aligned with the aperture 35 of the male ear 32 when the sections 23 and 24 are brought together, as shown in FIG. 3. Upon alignment of the apertures, hinge pin 33 is inserted vertically downwardly with an enlarged head portion 38 ultimately engaging the top surface of ear 30. The hinge pin may be formed from metal and the bottom protruding portion thereof may project below the bottom surface of ear 31 to receive thereon a friction washer 39 which clamps the pin in an operative position, as shown in FIG. 5.

Figure 4A:
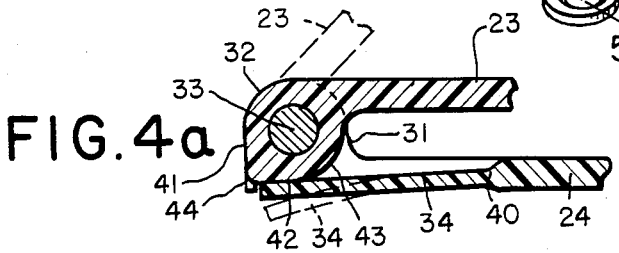

Locking tab 34 may be formed in any suitable manner and, as previously described, has a longitudinal extent and thickness which provides sufficient resilient forces to achieve a locking action. In the form illustrated, the locking tab, as shown in FIGS. 3, 4 and 4*a*, is integrally formed at its base 40 with the frame section 24 between hinge pin ears 30 and 31. The width of the locking tab as measured between ears 30 and 31 is less than the vertical spacing of such ears so as to permit free flexing of the tab 34 between the ears without interference therewith. The base portion 40 of locking tab 34 is illustrative of the manner in which the thickness of the tab can be varied so that the requisite resilient locking force is obtained.

Locking tab 34 operates against two essentially flat camming surfaces 41 and 42 on hinge pin ear 32. The outermost surface 41 extends in a plane transverse of the longitudinal axis of frame section 23. The inner surface 42 extends vertically but basically parallel to the opposite face of frame section 23, between a radius 43 and a camming surface 44 formed between camming surfaces 41 and 42.

When bag opener 20 is in its folded storage configuration, as illustrated in FIG. 2, living hinges 25 are relaxed and frame sections 23 and 24 lie in a parallel relationship. As shown in FIG. 4*a*, the projecting end of locking tab 34 is in engagement at this time with the camming surface 42. The inherent resiliency of this locking tab acts against the camming surface 42 to hold frame sections 23 and 24 in their folded side-by-side storage configuration.

FIGS. 4 and 4*a* illustrate the manner in which the expandable container frame 20 is reconfigured to an operating configuration. In FIG. 4*a* upward movement of frame section 23 is seen to result in camming surface 44 engaging the free end of locking tab 34, forcing the same downwardly as viewed in phantom and ultimately releasing the locking tab to bring it into engagement with camming surface 41, as shown in FIG. 4. Basically, camming surface 44 provides in conjunction with locking tab 34 an over-center locking arrangement. The flat camming surface 41 of male hinge pi member 32 is of sufficient extent and is adequately engaged with locking tab 34 to hold frame section 23 at substantially right angles with frame section 24.

In order to return the expandable container frame 20 to the flat storage condition illustrated in FIG. 2, it is necessary to apply sufficient force against frame sections 23 as illustrated in FIG. 4 to cause the frame sections to rotate toward frame sections 24. Camming surfaces 44 then engage locking tabs 34 to reverse the procedure previously described and, as best shown in FIG. 4*a*, each locking tab is cammed out of position to permit each frame section 23 to assume a side-by-side storage relationship with its adjacent frame section 24.

While camming surfaces 41 and 42 and the engaging surface of tab 34 have been shown as substantially flat surfaces, it will be appreciated that a recess or depression may be provided on the camming surfaces, and a raised tooth portion may be provided on the engaging surface to provide greater locking action where necessary.

Some operational uses of container frame 20 is illustrated in FIGS. 6 through 9. In FIG. 6, container frame 20 is shown being inserted while in its storage configuration in the opening of a flexible plastic bag 45 of conventional construction. As shown, the user grasps container frame with one hand and with the other hand stretches the opening of the plastic bag to insert the frame therein.

FIG. 7 illustrates the user manipulating container frame 20 to condition the same into an expanded configuration. To this end, sufficient force must be applied against oppositely facing frame sections to cause living hinges 25 to fold and permit movement of interconnected frame sections toward one another. The force applied by the user must also overcome the camming of locking tabs 34 by camming surfaces 44 to bring frame sections 23 and 24 into a perpendicular relationship. As this is being accomplished, as illustrated in FIG. 7, the open mouth portion of the flexible bag is retained around the outer surfaces of the container frame.

As shown in FIG. 8, sufficient force of engagement has occurred between container frame 20 and the open mouth of bag 45 so that the user can hold the bag opener and attached bag upright by grasping handles 26 while depositing debris in the bag. In this regard, the container frame is relatively light and does not add any material weight to the combination of the frame, flexible bag and collected trash. Furthermore, the entire volume of the flexible bag is available for use because the container frame has eliminated the necessity of draping a substantial portion of the bag over the top rigid edge of a can or other support container.

To further illustrate the versatility of the expandable container frame of the present invention, FIG. 9 illustrates use of the container frame on a supporting surface such as a floor or level ground so that a conventional broom 46 may be utilized to sweep leaves or other debris directly into the open bag.

Referring to FIG. 10, bag engaging means in the form of a plurality of projecting cone-shaped protuberances 50, preferably provided on the surface of an integral outwardly convex lip portion 51 extending along the length of frame sections 23 and 24, may be provided on frame members 21 and 22 to assist in retaining the bag. When the operation is complete and the locking tongues are in place to hold the bag opener in its expanded position, the material of the plastic bag surrounding the mouth is brought into tight engagement with the convex surface and the protuberances thereon of the container frame so that the frame and bag can be handled as a single unit. The bag opener described in connection with FIGS. 1 through 10 may be used as a component in a wall mounting system to be described.

FIGS. 11 through 14*b* illustrate an alternative container of the expandable container frame or bag opener of the present invention. This construction incorporates the basic principles referred to hereinabove and, accordingly, the description of this construction will be basically limited to specific differences.

The alternative container frame 55 includes a pair of identical frame members each composed of frame sections 56 and 57. The frame members are formed from a suitable plastic or semi-hard rubber material as previously described and each frame section 56 and 57 is integrally interconnected by a living hinge section 58. Integrally molded with the inner longitudinal surface of each frame section 56 and 57 are a plurality of vertically spaced reinforcing ribs 59 which terminate short of living hinge sections 58 and the opposite ends of the adjacent frame sections which are pivotally interconnected. Frame sections 56 are provided with upstanding, integrally formed handles 60 for utilization in the manner described hereinabove.

The living hinge sections 58 are best illustrated in FIGS. 11, 12, 13 and 13*a*. There, it can be seen that each hinge portion is of reduced width as compared to the adjacent frame sections (FIGS. 11 and 12), and is of reduced thickness as compared to the thickness of the adjacent frame sections (FIGS. 11, 13 and 13*a*). Accordingly, living hinge sections 58 function in the same manner as previously described in connection with living hinge sections 25.

Container frame 55 is provided with flexible plastic bag retention mean which are of a different configuration than the protuberances 50 previously described. In particular, upper and lower bag retention means 61 and 62, respectively, project outwardly in the form of fingers at opposite corners of the frame 55 when the same is moved into its expanded condition. The outwardly projecting fingers 61 and 62, which are formed integrally with frame sections 56, project upwardly and downwardly therefrom and extend in parallel relation with aligned frame sections 56 and 57 while overlying the underlying living hinge section 58 when each frame member is in its folded, parallel storage position. This relationship is best illustrated in FIG. 12. When the bag opener is expanded from its storage position to its container reinforcing position as shown in FIG. 11, fingers 61 and 62 project outwardly to engage the inner surface portion of the upper open periphery of a plastic container and expand the same even to the extent of exceeding its elastic limit thereby gripping the flexible plastic container and holding the same in fixed relation relative to the frame member during utilization of the combined frame member and container as described hereinabove. To further enhance this retention function and further promote localized stretching or puncturing of the plastic container, at least the outer end portion of upper finger 61 is provided with a pointed tip portion 63. Fingers 61 and 62 are reinforced by the provision of longitudinally extending ribs 64 to provide the requisite strength for supporting a filled plastic bag.

Similar to the construction described hereinabove, one end of each frame section 56 and 57 includes a hinge pin mounting area. As best illustrated in FIGS. 12 and 14, the hinge pin mounting ends of the frame sections 56 and 57 include a generally L-shaped ear portion 65 projecting first outwardly and then inwardly relative to the longitudinal axis of the frame section. The ear portion 65 is integrally formed with the frame sections and is centrally located along the vertical end of each frame section between upper and lower reinforcing and expanding flange portions 66 and 67, respectively. Each ear portion 65 has integrally formed therewith an upwardly projecting pivot pin portion 68 and a downwardly projecting pivot pin portion 69 which extend approximately the full vertical height of the adjacent frame section. The outermost surface of the ear portion 65 in the area in alignment with projecting pin portions 68 and 69 is provided with a fixed camming portion 70 which is provided with a hook-shape and extends continuously throughout the vertical height of ear portion 65. A recess 71 may be formed in the outer surface of ear 65 in accordance with the conventional material-saving plastic molding techniques.

As shown in FIG. 14, the opposite end of each frame section 56 and 57 is provided with a pivot pin receiving portion for pivotally interconnecting the frame sections in the manner previously described, and as illustrated in FIG. 11 to permit, in conjunction with operation of living hinge sections 58, expansion of the container frame to its open or operable position. In particular, expanding top and bottom reinforcing flanges 72 and 73 are provided at the opposite end of each frame section. The central portion of each end includes a resilient tab portion 74, which is isolated from reinforcing flange portions 72 and 73 by longitudinally extending slots 75 at either side. Each of the reinforcing flange portions 72 and 73 has integrally formed therewith along the outer and inner surface areas thereof, an upper ear portion 76 and a lower ear portion 77. Ear portions 76 and 77 are provided with vertically extending and centrally located apertures 78 designed to receive an aligned one of pivot pin portions 68 or 69 therein, and V-shaped slots 79 which guide an adjacent pivot pin into these apertures. The portions of each ear portion making up V-slots 79 are sufficiently flexible to permit movement of the pivot pin portions into the apertures without damage to the pin portions or the ear portions, while springing back into place to lock the pin within the aperture. Conversely, the resiliency of the ear portions in the area of the V-slots permits movement of the pivot pins out of the apertures to disconnect adjacent ends of the frame sections where necessary.

Upper ear portion 76 includes an outwardly projecting tip portion 80 which functions similarly to tip portion 63 to form an integral projecting finger 61 in each frame section. Thus, each corner of the expanded container frame is provided with an outwardly projecting portion which engages the periphery of the open end of a flexible bag and stretches or punctures the same to, in effect, hook the bag on the container. These cooperative protuberances effectively hold the stretchable bag on the frame while the bag is being filled even with relatively heavy refuse or other material.

Resilient tab portion 74 located between the parallel-spaced ear portions has formed along its outer vertical edge an inwardly projecting hook portion 81 of a configuration similar to the hook-like shape of camming portion 70. These hook portions cooperate to releasably lock the container frame in its expanded containerreinforcing position. FIG. 14*a* illustrates the pivotally interconnected ends of frame sections 56 and 57 as they are positioned in their parallel storage position. Resilient tab portion 74 extends outwardly in substantially parallel alignment with frame section 57 with its inwardly extending hook portion 81 riding in engagement with the outer curved surface of the adjacent centrally located ear portion 65 of frame section 56. As frame section 56 is pivoted relative to frame section 57 in the direction of the arrow illustrated in phantom in FIG. 14*a*, hook portion 81 rides along the fixed camming portion 70 and, in the process of relative movement, resilient tab portion 74 is cammed upwardly as illustrated in FIG. 14*b* out of alignment with frame section 57 sufficiently to permit hook portion 81 to move completely over camming portion 70 and snap into interlocking relationship therewith. This interlocking relationship is illustrated in FIG. 14*b*.

Thus, the container frame in its expanded position is locked into such position so as to effectively hold a flexible container or bag in open position for filling as described hereinabove. When it is desired to fold the container frame for storage purposes, resilient tab portion 74 may be grasped and flexed outwardly (upwardly as viewed in FIG. 14*b*), sufficiently to provide adequate clearance between the interlocking hook members thereby permitting pivoting of the interconnected frame sections back into parallel storage position.

FIG. 15 illustrates a mounting member in the form of a bracket 85 which, as illustrated in FIG. 11, is used in pairs to mount container frame 55 on a fixed surface, such as a wall or the like (not shown), in the elevated position to permit the holding of a flexible container or bag in a storage position or in an extended or expanded position for loading or unloading thereof. As previously mentioned, these mounting members may also be used with the container frame 20 in a similar manner.

Bracket 85 includes a rectangular body portion 86 having a centrally located rectangular opening 87 therein, the material of the body portion 86 in the area of opening 87 having been formed into a pair of outwardly projecting flange portions 88 and 90 as well as downwardly and upwardly projecting flange portions 89 and 91, respectively. Flange portions 88 and 89 define an upper, generally L-shaped flange member which extends outwardly and downwardly relative to bracket body 86. Flange portions 90 and 91 define a similar L-shaped flange member which extends outwardly and upwardly from body 86, the flange portions 89 and 91 being in opposed, spaced relationship. Outwardly (upwardly and downwardly) of the flange portions, bracket body 86 is provided with fastener holes 92 which extend through the plate and which receive fasteners 93 in th manner illustrated in FIG. 11. The container frame mounting means provided by bracket 85 may be formed from any suitable material capable of effectively holding the container frame as well as a container and container contents mounted on the frame as previously described.

FIG. 11 illustrates the mounting of a pair of brackets 85 on a frame section 56. Bracket body 86 extends transversely across the outer surface of frame section 56 with the inwardly extending flanged formed from portions 88, 89, 90 and 91 extending over or under the outer edges of frame section 56 and inwardly, downwardly and upwardly along the inner surface areas of reinforcing ribs 59. In this manner frame section 56, as well as the interconnected remaining frame sections of the total container frame, may be effectively supported by mounting brackets 85 when the same at attached to a suitable supporting surface in the manner previously described. One or more mounting brackets may be used depending upon the effective size of the container frame and, when using a pair of such brackets as illustrated in FIG. 11, they may be conveniently located on either side of handle 60 of a frame section 56 intermediate the same and the ends of the frame section.

Further referring to FIG. 11, and visualizing container frame 55 in a storage condition similar to that shown in FIG. 13 (or to that shown in FIG. 2 in connection with the earlier described embodiment of container frame), frame 55 when mounted on a vertical surface can receive and store a flexible container. Such a container is placed about the stored and mounted container frame in the manner illustrated in FIG. 6, projecting finger portions 63 and 80 of the frame engaging the inner surface of the open periphery of the flexible container and either stretching or piercing the adjacent material to hold the container. Handle 60 or any other suitable portion of frame section 56 may then be grasped to move frame 55 and the engaged periphery of the flexible container into an extended or opened position.

If the flexible container is empty and has merely been held on the container frame by the projecting finger portions 63 and 80, as the container frame moves into its extended position carrying the open periphery of the flexible container therewith, the remaining fingers 63 and 80 of frame section 56 either stretch or pierce the periphery of the flexible container and provide further support for the same and its ultimate contents. Mounting brackets 85 space container frame 55 outwardly from a supporting surface, such as a wall, to permit the frame to receive a flexible bag thereon in the manner illustrated in FIG. 6.

The bag opener described herein is rectangular, and therefore conform to the rectangular shape of the conventional plastic bag and permit full extension thereof. However, it will be appreciated that the bag opener can be formed in other configurations and sizes to accommodate bags of different shapes and sizes. For example, trash bags are commonly available in 4 gal. (1 ft. 5 in.×1 ft. 6 in.), 13 gal. (2 ft.×2 ft. 6 in.), 30 gal. (2 ft. 6 in.×3 ft.), 33 gal. (2 ft. 9 in.×3 ft. 4 in.) and 39 gal. (2 ft. 8 in.×3 ft. 9 in.) capacities, with thicknesses ranging from 1.2 mil. to 1.5 mil. or greater, and 1–2 or more plies, and it is contemplated that the bag opener of the invention would be provided in appropriate sizes to accommodate these capacities. It is further contemplated that the size of a particular bag opener would be identified by appropriate indicia on the outside surface of one or more of the frame segments.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. An expandable container frame for imparting rigidity to the periphery of the opening of a flexible container to facilitate loading or unloading thereof, said frame comprising:

foldable frame members configurable between a storage position wherein the frame members fit within the container opening, and an extended position wherein the frame members engage the container about its inner periphery; and locking means carried by said frame members, said locking means including a flexible member carried by one of said frame members and an inter-engaging camming member carried by the other of said frame members, each said flexible members and each said camming member being provided with releasable indexing surfaces which inter-engage in said extended position to releasably lock said frame members in said extended position.

2. A container frame as defined in claim 1 wherein said foldable frame members each include opposite ends and are integrally provided with a flexible living hinge portion intermediate said ends, each of said frame members being provided with hinge assemblies on said opposite ends, and said frame members being interconnected at said ends by said hinge assemblies.

3. A container frame as defined in claim 2 wherein said foldable frame members are of identical configuration, and are disposed side-by-side in said storage position.

4. A container frame as defined in claim 2 wherein each assembly includes projecting ear members and pivot pins interconnecting said ear members.

5. A container frame as defined in claim 4 wherein certain of said ear members which receive said pivot pins are provided with slots through which said pins are retractably received, thereby permitting quick assembly and disassembly of said frame members.

6. A container frame as defined in claim 5 wherein said foldable frame members are of identical configuration, and are disposed side-by-side in said storage position.

7. A container frame as defined in claim 4 wherein certain of said ear members which receive said pivot pins are provided with slots through which said pins are retractably received, thereby permitting quick assembly and disassembly of said frame members, said foldable frame members are of identical configuration, and are disposed side-by-side in said storage position.

8. A container frame as defined in claim 4 wherein each of said frame members includes a handle.

9. An expandable container frame for holding the open end of a plastic bag open, comprising:

first and second elongated relatively rigid frame members;

said first and second frame members being identical and each including a living hinge portion of limited longitudinal extent located between the ends thereof, said living hinge portions being formed integrally with said frame members and allowing folding of said frame members between said ends;

connection means for pivotally connecting the opposite ends of said first and second frame members, whereby said members are extendable from a side-by-side storage position to an extended position wherein said members are folded at substantially right angles at said living hinge portions; and locking means for maintaining said frame members in said extended position.

10. A container frame as defined in claim 9 wherein said connection means comprise a pair of parallel-spaced ear members located at one end of each said frame member, and a single ear member located at another end of each said frame member, said single ear member of each said frame member being disposed between and aligned with said parallel-spaced ear members of the other of said frame members, said single ear member including a pair of pivot pins which extend through said aligned ear members to form a pivotal connection therebetween.

11. A container frame as defined in claim 9 or claim 10 wherein said locking means comprise a resilient tab member extending from one end of each said frame member and a camming surface extending from the other end of each frame member, said tab member of each said frame member engaging said camming surface of the other of said frame members to releasably lock said frame members in said extended position.

12. A container frame as defined in claim 11 wherein said resilient tab member is positioned between said parallel-spaced ear members and includes an inwardly projecting first indexing surface adjacent the free end thereof, said camming surface extending the width of said single ear member and including an outwardly projecting second indexing surface for engagement with said first indexing surface in said extended position.

13. A container frame as defined in claim 12 wherein each of said frame members includes handle.

14. A container frame as defined in claim 10 wherein said one end of said first frame member and said other end of said second frame member each includes an additional camming surface for engaging said tab members to releasably lock said frame members in said side-by-side storage position.

15. A container frame as defined in claim 10 wherein said pair of pivot pins are formed integrally with said single ear members one of said pivot pins projecting upwardly and the other of said pivot pins projecting downwardly therefrom, said parallel-spaced ear members each being provided with vertically extending v-slots through which said upwardly and downwardly projecting pivot pins are releasably received.

16. A container frame as defined in claim 9, said container frame further comprising bag retention means, said bag retention means being adjacent to and overlying said living hinge portion and projecting outwardly of said frame member when said frame member is folded along said living hinge portion.

17. A container frame as defined in claim 9 wherein said frame members are provided with reinforcing ribs extending longitudinally there along.

18. The expandable container frame of claim 9, wherein said living hinge portion is of reduced width and reduced thickness than that of said one frame member.

19. A foldable and expandable container frame adapted for use with flexible bags, said container frame comprising:

a pair of elongated frame members;

hinge pin receiving means formed on one end of each of said frame members;

a pair of hinge pins formed on each of the remaining ends of each of said frame members, said hinge pins engaging said hinge pin receiving means and thereby pivotally interconnecting said frame members at said opposite ends thereof;

a flexible area :forming a part of each of said frame members intermediate said opposite ends thereof whereby said frame members can be folded, each said flexible area being formed integrally with one of aid frame members;

bag retention means formed integrally with each said frame member, said bag retention means being adjacent to and overlying said flexible area and projecting outwardly of said bag opener when said frame member is folded along said flexible area; and locking means carried by said frame members and inter-engaging the same to releasably lock said frame members in an expanded bag opening condition.

20. A container frame as defined in claim 19 wherein said frame members are of identical configuration, and said flexible area of each of said frame members comprises a living hinge portion.

21. A container frame as defined in claim 20 wherein said hinge pin receiving means includes a pair of spaced apertured ears, and a single ear portion, said ear portion being adapted to be received between and aligned with said spaced apertured ears.

22. A container frame as defined in claim 21 wherein said locking means include a resilient tab portion extending from each said frame member between said spaced apertured ears, said single ear portion of each frame member including an indexing surface portion which said resilient tab portion engages in the expanded condition of said container frame.

23. A container frame as defined in claim 19 wherein said hinge pin receiving means includes a pair of spaced apertured ears, and a single ear portion, said ear portion being adapted to be received between and aligned with said pair of spaced apertured ears.

24. A container frame as defined in claim 19 wherein each said flexible area is of a narrower width and of reduced thickness than the rest of said frame member.

25. A container frame as defined in claim 19 wherein said locking means include a flexible member carried by one of said frame members and an inter-engaging camming member carried by the other of said frame members, each said flexible member and aid camming member being provided with releasable locking hook members which inter-engage in the expanded bag opening condition.

26. The container frame as defined in claim 19, said container frame further comprising mounting means releasably attachable to one of said frame members for attachment to a supporting surface to hold said frame and any container engaged thereby in said storage position or said extended position.

27. A container frame as defined in claim 26 wherein said mounting means is in the form of a plate having a pair of mounting flanges projecting outwardly in vertically spaced relation and then projecting inwardly toward one another and receiving a frame member therebetween.

28. A foldable expandable container frame adapted for use for with flexible bags, said container frame comprising:

a pair of elongated frame members;

hinge pin receiving means formed on one end of each of said frame members;

a pair of hinge pins formed on each of the remaining ends of each of said frame members, said pins engaging said hinge pin receiving means and thereby pivotally interconnecting said frame members at said ends thereof;

a flexible area forming a part of each of said frame members intermediate said opposite ends thereof, each said flexible area being formed integrally with one of said frame members;

bag retention means formed integrally with each said frame members, said bag retention means being adjacent to and overlying said flexible and projecting outwardly of said bag opener when said frame member is folded along said flexible area; and locking means carried by said frame members, said locking means including a flexible member carried by one of said frame members and an inter-engaging camming member carried by the other of said frame members, each said flexible member and said camming member being provided with releasable indexing surface which inter-engage in the expanded bag opening condition.

29. A container frame as defined in claim 25 wherein said frame members are of identical configuration, and said flexible area of each of said frame members comprises a living hinge portion, said hinge portion being of reduced width and of reduced thickness than that of said one member.

30. A container frame as defined in claim 29 wherein said hinge pin receiving means includes a pair of spaced apertured ears and a single ear portion, said ear portion being adapted to be received between and aligned with said spaced apertured ears.

31. A container frame as defined in claim 30 wherein said locking means include a resilient tab portion extending from each said frame member between said spaced apertured ears, said single ear portion of each frame member including an indexing surface portion which said resilient tab portion engages in the expanded condition of said container frame.

32. A container frame as defined in claim 28 wherein said hinge pin receiving means includes a pair of spaced apertured ears and a single ear portion, said ear portion being adapted to be received between and aligned with said pair of spaced apertured ears.

33. A container frame as defined in claim 28, said container frame further comprising mounting means releasably attachable to one of said frame members for attachment to a supporting surface to hold said frame and any container engaged thereby in said storage position or said extended position.

34. A container frame as defined in claim 33 wherein said mounting means is in the form of a plate having a pair of mounting flanges projecting outwardly in vertically spaced relation and then projecting inwardly toward one another and receiving a frame member therebetween.

35. An expandable container frame for holding the open end of a plastic bag open, comprising:

first and second elongated relatively rigid frame members;

said first and second frame members being identical and each including a living hinge portion of limited longitudinal extent located between the ends thereof and allowing folding of said frame members between said ends;

bag retention means formed integrally with each frame member, said bag retention means being adjacent to and overlying said living hinge portion and projecting outwardly of said frame member when said frame member is folded along said living hinge portion;

connection means for pivotally connecting the opposite ends of said first and second frame members, whereby said members are extendable from a side-by-side storage position to an extended position wherein said members are folded at substantially right angles at said living hinge portions; and locking means for maintaining said frame members in said extended position.

36. The container frame of claim 35 wherein said connection means comprise a pair of parallel-spaced ear members located at one end of each said frame member, and a single ear member located at another end of each said frame member, said single ear member of each said frame member being disposed between and aligned with said parallel-spaced ear members of the other of said frame members, said single ear member including a pair of pivot pins which extend through said aligned ear members to form a pivotal connection therebetween.

37. The container frame of claim 35 or claim 36 wherein said locking means comprise a resilient tab member extending from one end of each frame member and a camming surface extending from the other end of each said frame member, said tab member of each said frame member engaging said camming surface of the other of said frame members to releasably lock said frame members in an extended position.

38. A container frame as defined in claim 37 wherein said resilient tab member is positioned between said parallel-spaced ear members and includes an inwardly projecting first indexing surface adjacent the free end thereof, said camming surface extending the width of said single ear member and including an outwardly projecting second indexing surface for engagement with said first indexing surface in said extended position.

39. A container frame as defined in claim 38 wherein each of said frame members includes a handle.

40. A container frame as defined in claim 36, wherein said one end of said first frame member and said other end of said second frame member each includes an additional camming surface for engaging said tab members to releasably lock said frame members in said side-by-side storage position.

41. A container frame as defined in claim 36 wherein said pair of pivot pins are formed integrally with said single ear members, one of said pivot pins projecting upwardly and the other of said pivot pins projecting downwardly therefrom said parallel-spaced ear members each being provided with vertically extending V-slots through which said upwardly and downwardly projecting pivot pins are releasably received.

42. A container frame as defined in claim 35 wherein said frame members are provided with reinforcing ribs extending longitudinally there along.

* * * * *